US009885172B2

(12) United States Patent
Rahimzadeh et al.

(10) Patent No.: US 9,885,172 B2
(45) Date of Patent: Feb. 6, 2018

(54) BUILDING STRUCTURE INCLUDING BALCONY

(75) Inventors: Housh Rahimzadeh, Alpharetta, GA (US); Marc Rahimzadeh, Alpharetta, GA (US)

(73) Assignee: DIVERSAKORE LLC, Alpharetta, GA (US)

( * ) Notice: Subject to any disclaimer, the term of this patent is extended or adjusted under 35 U.S.C. 154(b) by 1376 days.

(21) Appl. No.: 13/383,031

(22) PCT Filed: Jul. 8, 2010

(86) PCT No.: PCT/US2010/041371

§ 371 (c)(1),
(2), (4) Date: Jun. 15, 2015

(87) PCT Pub. No.: WO2011/005961

PCT Pub. Date: Jan. 13, 2011

(65) Prior Publication Data

US 2015/0292193 A1 Oct. 15, 2015

Related U.S. Application Data

(60) Provisional application No. 61/223,757, filed on Jul. 8, 2009.

(51) Int. Cl.

| | |
|---|---|
| ***E04B 1/19*** | (2006.01) |
| ***E04B 5/02*** | (2006.01) |
| ***E04B 5/04*** | (2006.01) |
| ***E04B 5/29*** | (2006.01) |

(Continued)

(52) U.S. Cl.

CPC ..... *E04B 1/19* (2013.01); *E04B 1/30* (2013.01); *E04B 5/02* (2013.01); *E04B 5/043* (2013.01); *E04B 5/29* (2013.01); *E04C 3/36* (2013.01); *E04B 2001/199* (2013.01); *E04B 2001/1972* (2013.01)

(58) Field of Classification Search

CPC ..... E04B 1/19; E04B 1/30; E04B 5/02; E04B 5/29; E04B 5/043; E04B 2001/1972; E04B 2001/199; E04C 3/36

See application file for complete search history.

(56) References Cited

U.S. PATENT DOCUMENTS

| | | | | |
|---|---|---|---|---|
| 3,487,597 A | | 1/1970 | Gutt | |
| 3,800,491 A | * | 4/1974 | Gunia | E04B 5/04 52/602 |

(Continued)

FOREIGN PATENT DOCUMENTS

| | | | | |
|---|---|---|---|---|
| CN | 204401804 U | * | 6/2015 | |
| GB | 2127083 A | * | 4/1984 | E04B 1/003 |
| WO | 2009002865 | | 12/2008 | |

OTHER PUBLICATIONS

Office Action in Corresponding Canadian Patent Application No. 2,767,517, dated Jun. 29, 2016.

*Primary Examiner* — Jeanette E Chapman

(74) *Attorney, Agent, or Firm* — Stephen J. Terrell; Parks IP Law LLC

(57) ABSTRACT

A building structure with a balcony includes a beam with an upward facing cavity. The beam includes an opening in which a cantilevered section is received. The cantilevered section has a proximal end that is positioned in the cavity and a poured bonding structure fills the cavity.

20 Claims, 6 Drawing Sheets

(51) Int. Cl.
*E04B 1/30* (2006.01)
*E04C 3/36* (2006.01)

(56) References Cited

U.S. PATENT DOCUMENTS 4,903,448 A * 2/1990 Compton ..... E04B 1/215
403/187
5,653,077 A 8/1997 Carnicello et al.
5,978,997 A * 11/1999 Grossman ..... E01D 2/02
14/73
6,543,195 B2 * 4/2003 Rahimzadeh ..... E04B 1/165
52/320
6,807,789 B1 * 10/2004 Kim ..... E01D 19/125
52/847
7,143,554 B2 * 12/2006 Sachs ..... E04C 3/34
52/232
8,800,229 B2 * 8/2014 Rahimzadeh ..... E04B 1/30
52/251
8,898,992 B2 * 12/2014 Rahimzadeh ..... E04B 1/165
403/187
9,096,999 B2 * 8/2015 Rahimzadeh ..... E04B 1/1903
9,512,616 B2 * 12/2016 Rahimzadeh ..... E04B 1/30
9,523,188 B2 * 12/2016 Rahimzadeh ..... E04B 1/30

* cited by examiner

BUILDING STRUCTURE INCLUDING BALCONY

CROSS REFERENCE TO RELATED APPLICATION

This application claims priority to U.S. Provisional Application No. 61/223,757, filed Jul. 8, 2009, the entirety of which is herein incorporated by reference.

TECHNICAL FIELD

This invention relates generally to building construction and, more specifically, to a building structure including a balcony.

BACKGROUND

In the field of building construction, and specifically with respect to the erection of multi-story buildings, a building structure typically includes a framing structure and a flooring structure. The framing structure includes the main load-bearing structure of a building that maintains the stability and structural integrity of the building. The flooring structure includes the floor that is supported by the framing structure. The typical multi-story building structure consists of a plurality of columns that are interconnected with beams and flooring sections that are supported by the beams.

The Applicant desires to create a need and market for an improved building structure that includes a balcony. Such a building structure may satisfy future needs by providing increased resistance to damage due to weather, a stable balcony structure, and drainage capability. These and other aspects of the present invention will become readily apparent from the description provided herein.

SUMMARY

The various embodiments of the present invention provide a building structure that integrates a cantilevered section with elements of a flooring structure and a framing structure to provide a balcony. The cantilevered section includes an end that is embedded in a poured bonding structure. The poured bonding structure also integrates elements of the flooring structure, elements of the framing structure, and elements of the flooring structure with elements of the framing structure.

As the end of the cantilevered section is embedded in the poured bonding structure, the cantilevered section can be assembled with the framing structure and the flooring structure prior to integrating the assembled elements with a poured bonding structure. This can reduce the time to erect the building structure as well as create a highly stable balcony. In addition, a connection between the cantilevered section and other elements of the building structure is hidden and weather resistant.

The poured bonding structure supports an embedded end of the cantilevered section and can further embed a connection between the cantilevered section and elements of the building structure. For example, the cantilevered section can be connected to the building structure before the poured bonding structure is formed and the connection can be embedded in the poured bonding structure when the poured bonding structure is formed. Accordingly, the connection is hidden and protected from damage, for example, due to weather.

The poured bonding structure provides and/or reinforces a connection between the cantilevered section and the building structure, which permits the balcony to have an increased length while maintaining the stability of the balcony. In addition, a connection that is reinforced by the poured bonding structure is permitted to be relatively weak. For example, a short fillet weld connection that is faster to apply although potentially weaker than a full length fillet may be used to reduce the time that is required to assemble the building structure since the weld connection is reinforced by the poured bonding structure.

The end of the cantilevered section is inset with respect to the point at which the cantilevered section begins to be embedded in the poured bonding structure. The distance that the end of the cantilevered section is inset is a function of the support to the cantilevered section.

To improve the drainage capability of the framing structure, the top surface of the flooring structure can be raised with respect to the top surface of the cantilevered section. A ridge or lip is positioned therebetween. The lip keeps water from flowing from the top surface of the cantilevered section to the top surface of the floor structure. The poured bonding structure can provide the top surface of the floor structure.

According to an exemplary embodiment, a building structure includes a beam, a cantilevered section, and a poured bonding structure. The beam includes a first side wall that defines, in part, an upward facing cavity and the first side wall includes an opening. The cantilevered section is received in the opening and a proximal end of the cantilevered section is positioned in the cavity. The poured bonding structure at least partially fills the cavity to embed the proximal end of the cantilevered section.

The building structure can further include means for securing the position of the proximal end of the cantilevered section in the cavity to position and support the cantilevered section before the poured bonding structure is formed. For example, means for securing the position can include a plate, an anchor embedded in a pre-cast concrete slab, a stud, rebar, other weldable joints, other elements that can be welded together, elements that can be bolted to one another, elements that hook to one another, elements that are mechanically fastened to one another, combinations thereof, and the like.

For example, means for securing can include one or more connecting elements that connect the proximal end of the cantilevered section to the building structure to secure the position of the proximal end of the cantilevered section. The connecting elements can be positioned in the cavity and embedded in the poured bonding structure. Here, the connecting elements provide a first connection between the building structure and the cantilevered section and the poured bonding structure provides a second connection to reinforce the first connection. Where the exemplary first connection is provided by metal components that are welded together, the poured bonding structure protects the metal components from rusting, corroding, or other potential damage due to exposure.

In certain embodiments, the building structure further includes a flooring section that includes an end that is supported by the beam opposite the first side wall. The supported end defines the cavity and can include hollow voids that open to the cavity. The poured bonding structure fills the hollow voids to connect the flooring section to the other elements of the building structure. The poured bonding structure includes a layer that is formed on the flooring section. The layer can include an upper surface that is raised with respect to the upper surface of the cantilevered section such that there is a lip or ridge that prevents drainage from the cantilevered section onto the floor surface defined by the layer.

According to an exemplary embodiment, a column supports an end of the beam. The column includes a hollow interior and an opening to the hollow interior that is aligned with the cavity. Accordingly, poured bonding material that is poured into the beam can flow through the opening and the poured bonding structure fills the hollow interior.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

As required, detailed embodiments of the disclosure are described herein. It must be understood that the disclosed embodiments are merely exemplary examples that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the disclosure. Therefore, specific structural and functional details disclosed herein are not to be interpreted as limiting, but merely as a basis for the claims and as a representative basis for teaching one skilled in the art.

Figure 1:
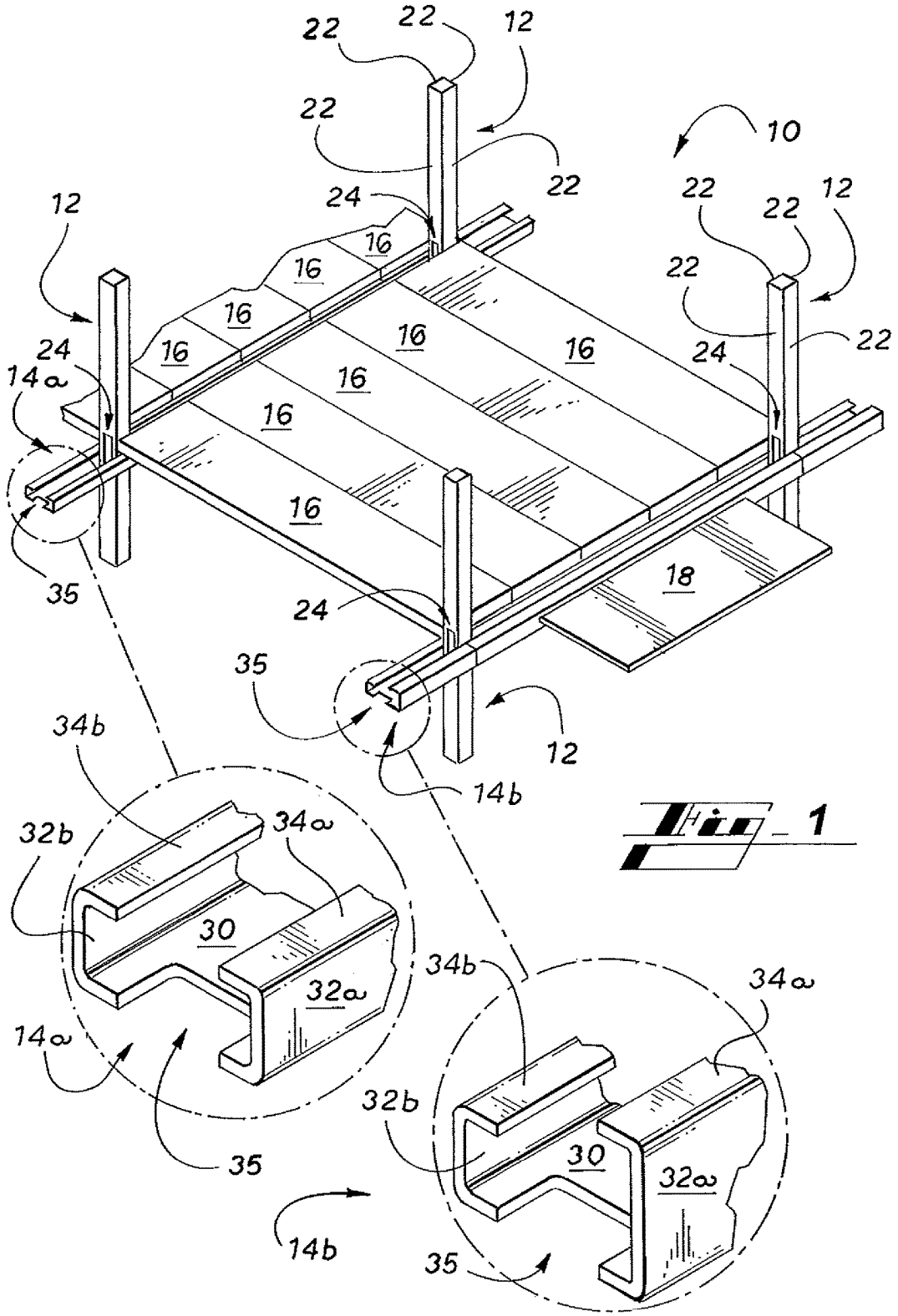
FIG. 1 is a partial perspective view of a framing structure, according to a first exemplary embodiment of the present disclosure.
Figure 2:
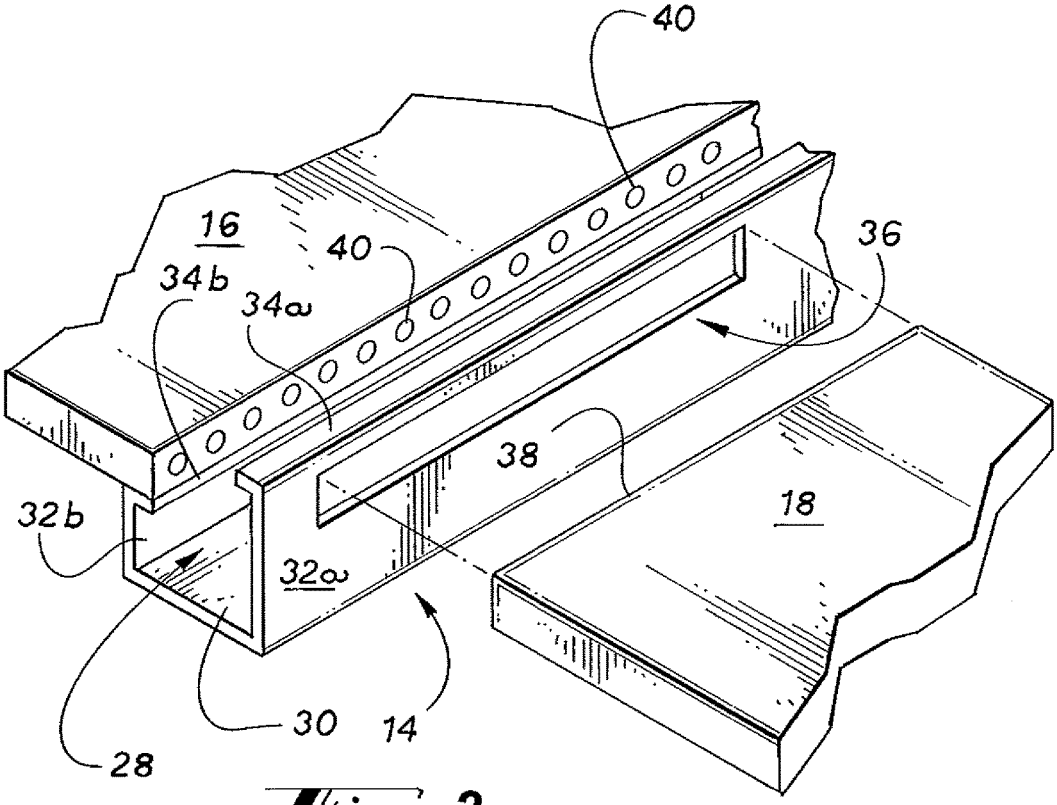
FIG. 2 is an exploded partial perspective view of the framing structure of FIG. 1.
Figure 3:
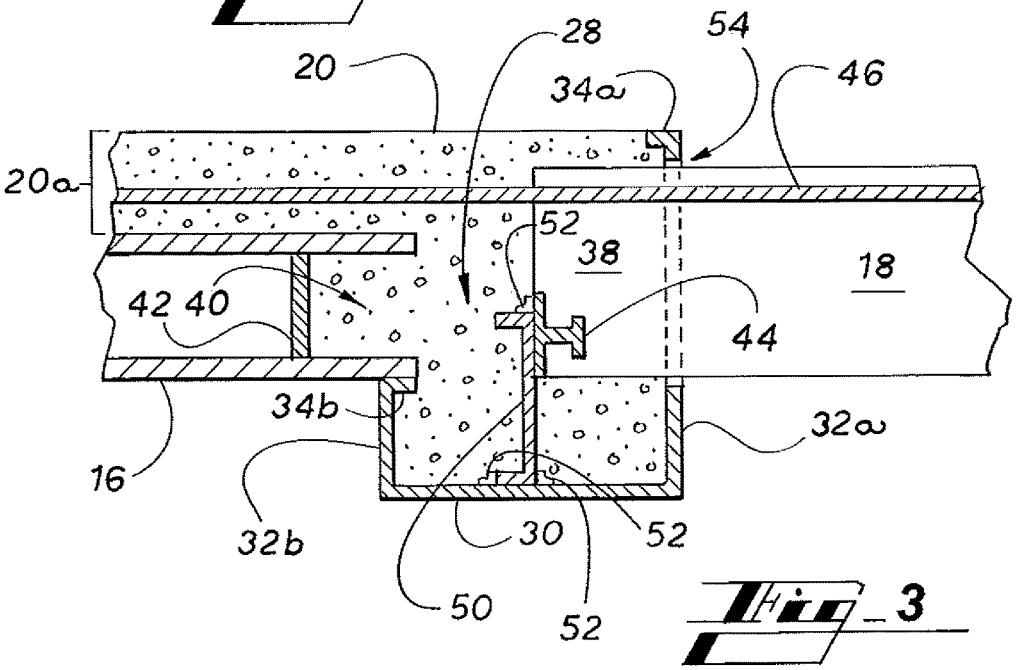
FIG. 3 is a partial cross-sectional view of the framing structure of FIG. 1.

Referring to FIGS. 1-4, a first exemplary embodiment of a building structure is described. Referring to FIG. 1, a building structure 10 includes a framing structure and a flooring structure that are integrally connected by a poured bonding structure. Specifically, the illustrated building structure 10 includes a plurality of columns 12, a plurality of beams 14, a plurality of flooring sections 16, a cantilevered section 18, and a poured bonding structure 20 (FIG. 3).

The columns 12, beams 14, flooring sections 16, and cantilevered section 18 can be formed from material or materials that have characteristics which meet or exceed minimum performance requirements such as but not limited to steel, aluminum, wood, pre-cast concrete, composite materials, combinations thereof, and the like.

The illustrated flooring sections 16 and the illustrated cantilevered section 18 are pre-cast concrete. In alternative embodiments, the flooring sections and cantilevered sections can include metal deck sections, wood planks, solid pre-cast concrete planks, aerated autoclaved concrete planks, poured-in-place structures, double T planks, single T planks, post-tensioned pre-cast sections, composite structures, slabs, plates, combinations thereof, and the like.

The poured bonding structure 20 is a pourable bonding material 20 that has solidified. As used herein, the term "pourable bonding material" is used to include a bonding material in a moldable or substantially fluid state and the term "poured bonding structure" is used to include a bonding material in a substantially rigid state. Bonding materials can include concrete, plasticized materials, cementitious materials, cement, grout, Gyperete®, combinations thereof, and the like.

Continuing with FIG. 1, generally described, the beams 14 extend in a longitudinal direction and the ends thereof are supported by columns 12 at a height that corresponds to a floor or level of the building structure 10. Flooring sections 16 extend in a transverse direction and the ends thereof are supported by beams 14. The flooring sections 16 provide a base layer of a floor of the building structure 10. The illustrated cantilevered sections 18 provide an extension of the floor and are supported at one end. As will be described in further detail below, the poured bonding structure 20 integrates the columns 12, the beams 14, the flooring sections 16, and the cantilevered section 18. Accordingly, the building structure 10 is substantially unitary and has improved structural characteristics.

Referring to FIGS. 1-4, the elements of the building structure 10 are described in further detail. The illustrated framing structure is formed from pluralities of like-numbered elements that are substantially similar. Although only a representative one or representative ones of the like-numbered elements may be described in detail, this description is generally applicable to each of the other like-numbered elements. Numbers alone are used to generally reference a like-numbered element or group of like numbered elements and suffixes such as "a" or "b" are attached to the numbers in order to reference individual ones of the like-numbered elements.

Referring to FIG. 1, the illustrated column 12 is a hollow-interior, box-style beam having a substantially square cross-section defined by four walls 22. The column 12 includes openings 24 that are disposed in certain of the walls 22 so as to provide a passageway between the exterior and the hollow interior of the column 12. The size, shape, and number of openings 24 are determined so as to allow the pourable bonding material 20 to flow through the opening 24 without substantially adversely affecting the structural integrity of the column 12. The illustrated openings 24 are disposed in the column 12 at positions that generally correspond to where the ends of beams 14 substantially meet the column 12. In other words, the openings 24 are positioned to generally correspond to the floors of the building structure 10. The openings 24 of the columns 12 substantially align with cavities 28 of the beams 14. In alternative embodiments not using hollow columns, there is no opening 24.

Figure 4:
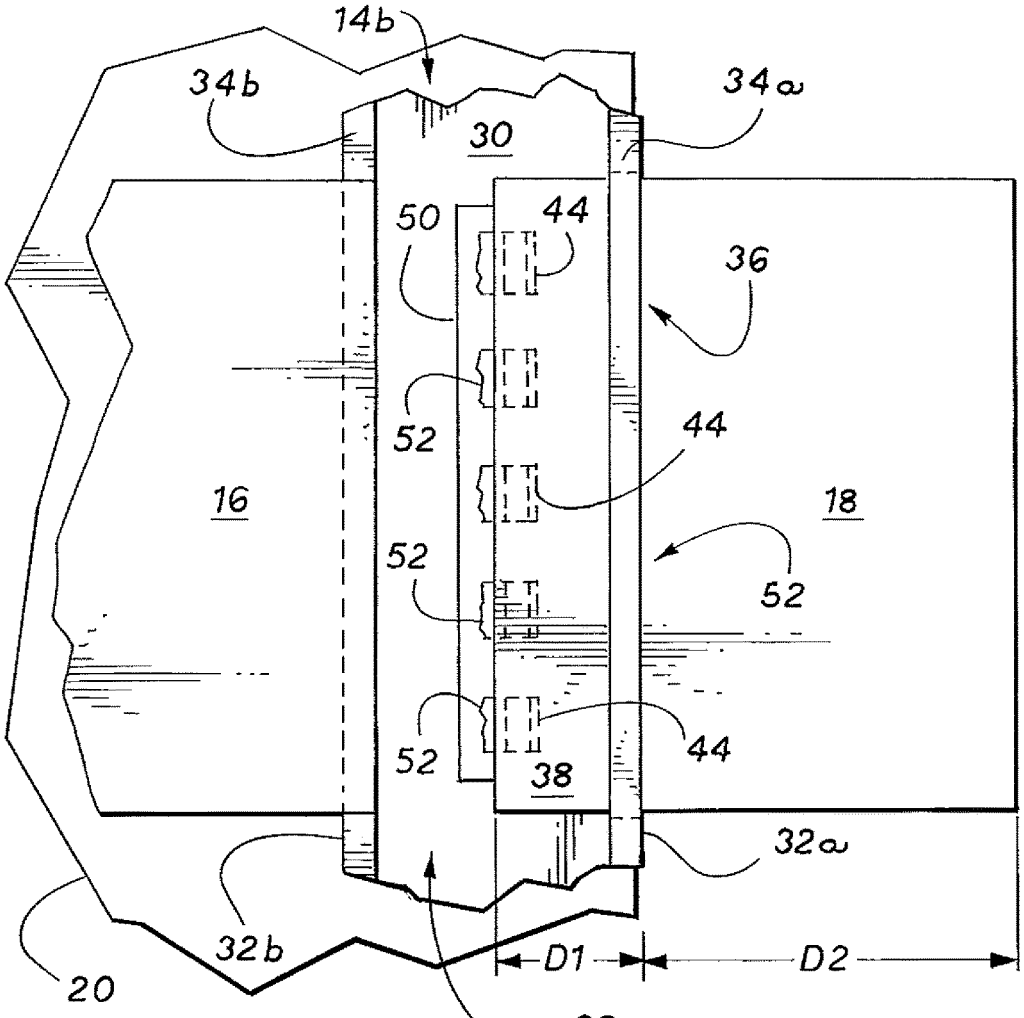
FIG. 4 is a partial plan view of the framing structure of FIG. 1.

Continuing with FIG. 1, the illustrated building structure 10 includes two types of beams 14*a*, 14*b* that are substantially similar except that the inner beam 14*a* is configured to support ends of opposing flooring sections 16 while the outer beam 14*b* is configured to support an end of a flooring section 16 and to support the cantilevered section 18. Referring now to FIGS. 2-4, each beam 14*a*, 14*b* has a trough-like or channel-like structure and is oriented such that the cavity 28 is upward facing. The cavity 28 functions to receive and retain pourable materials. Each of the illustrated beams 14*a*, 14*b* has a squared, U-shaped cross section. The inner beam 14*a* is symmetric with side walls being substantially the same length while the outer beam 14*b* is asymmetric with one side wall being longer than the other. In alternative embodiments, the cross-section of the beam 14 can be L-shaped, V-shaped, rounded U-shaped, H-shaped, and any other shape that provides the functionality described herein.

Each of the illustrated beams 14*a*, 14*b* includes a base wall 30 and side walls 32*a*, 32*b* that extend vertically upward from the base wall so as to define the cavity 28. flanges 34*a*, 34*b* extend inwardly from the upper ends of the respective side walls 32*a*, 32*b* and can provide a surface for supporting flooring sections 16, as described in further detail below. Alternatively, the flanges 34*a*, 34*b* can be arranged to extend outwardly from the side walls 32*a*, 32*b*, one flange can extend inwardly and the other outwardly, and flanges can extend both inwardly and outwardly. The end of each of the illustrated beams 14*a*, 14*b* further includes a notch 35 (FIG. 1) that is configured to receive a column 12. The shape of the notch 35 is substantially that of the cross section of the column 12.

Referring to FIGS. 1 and 2, the outer side wall 32*a* of outer beam 14*b* is taller than the inner side wall 32*b* of outer beam 14*b* and includes an opening 36 that is configured to receive a proximal or supported end 38 of the cantilevered section 18. The shape of the opening 36 is substantially that of the cross section of the cantilevered section 18 to obstruct pourable bonding material 20 from flowing through the opening 36 once the cantilevered section 18 is received in the opening 36.

Referring to FIGS. 2 and 3, the illustrated flooring sections 16 include hollow voids 40 that facilitate integration of the flooring sections 16 with the other elements of the building structure 10, as described in further detail below. In the illustrated embodiment, each of the hollow voids 40 is plugged with a core stop 42 that is positioned within the hollow void 40 at a distance from the open end of the hollow void 40.

The illustrated cantilevered section 18 includes an anchor 44 to facilitate securing the supported end 38 of the cantilevered section 18 in the cavity 28 of the outer beam 14*b*. The illustrated anchor 44 is a metal structure that is embedded in the supported end 38 of the cantilevered section 18. The illustrated cantilevered section 18 also includes a length of rebar 46 that is at least partially embedded in the cantilevered section 18. An end of the rebar 46 extends from the cantilevered section 18 through the cavity 28 and over the flooring section 16 so as to be positioned to be embedded in the poured bonding structure 20. In alternative embodiments, the rebar 46 also functions as the anchor 44, as described below.

An exemplary method of constructing the building structure 10 is now described. It is contemplated that the building structure 10 can be erected according to alternative methods. For example, the order of the steps of the exemplary method can be altered, steps can be added, and steps can be omitted. Referring first to FIG. 1, a plurality of columns 12 are substantially vertically erected and a plurality of beams 14 are positioned to extend substantially horizontally and longitudinally between erected columns 12 such that the cavities 28 of the beams 14 align with the openings 24 of the columns 12.

The ends of adjacent beams 14 abut one another and a column 12 is received in the notches 35 therebetween. The abutting ends of the side walls 32*a*, 32*b* of the beams can be attached, such as by bolting or welding, to one another. Abutting beams 14 provide a substantially continuous beam 14 having a base wall 30 that is interrupted by a column 12 and having side walls 32*a*, 32*b* and flanges 34*a*, 34*b* that are substantially continuous. As such, pourable bonding material 20 that is poured into the beam 14 can flow into and around the column 12.

Flooring sections 16 are supported at opposed ends by beams 14. One end of each illustrated flooring section 16 is supported by the side wall 32*a* and flange 34*a* of the inner beam 14*a* and the other end of each flooring section 16 is supported by side wall 32*b* and flange 34*b* of the outer beam 14*b*. Referring to FIGS. 2 and 3, the end of the illustrated flooring section 16 that is supported by the flange 34*b* of the outer beam 14*b* partially defines a wall of the cavity 28 of outer beam 14*b*. The hollow voids 40 are adjacent the cavity 28 such that the hollow voids 40 are filled with pourable bonding material 20 as the cavity 28 is filled with pourable bonding material 20.

Continuing with FIGS. 2-4, the supported end 38 of the cantilevered section 18 is inserted through the opening 36 such that the supported end 38 is positioned in the cavity 28 with a distance D1 between the side wall 32*a* and the innermost end wall of the cantilevered section 18. The distance D1 can be increased to increasingly support the supported end 38 of the cantilevered section 18 as the supported end 38 is more deeply embedded in the poured bonding structure 20. The cantilevered section extends from the side wall 32*a* for a distance D2.

Figure 5:
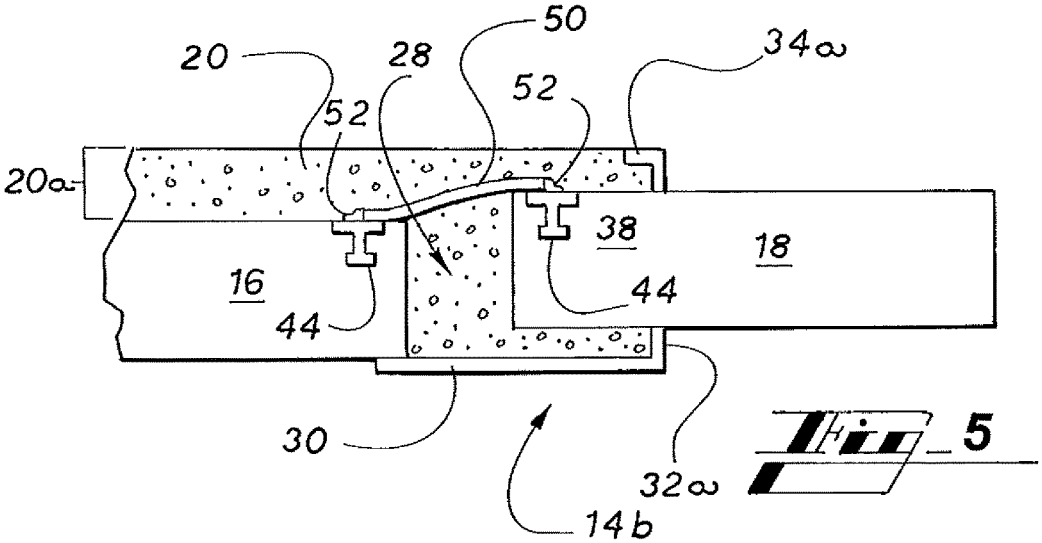
FIG. 5 is a partial cross-sectional view of a framing structure according to an alternative exemplary embodiment of the present disclosure.

In the illustrated embodiment, the anchor 44 and a plate 50 are configured to secure the position of the cantilevered section 18. Particularly, the supported end 38 is positioned in the cavity 28 prior to the pourable bonding material 20 being poured. The illustrated plate 50 is fillet welded 52 to the base wall 30 and extends into the cavity 28 so as to be positioned to abut the anchor 44 as the supported end 38 is positioned in the cavity 28. The abutting anchor 44 and plate 50 are fillet welded 52 together to secure the position of the cantilevered section 18. In alternative embodiments, the anchor 44 is eliminated and the rebar 46 is attached to the plate 50. Thus the anchor may be rebar or another element such as a plate. Referring momentarily to an alternative embodiment illustrated in FIG. 5, each of a flooring section 16 and a cantilevered section 18 include anchors 44 and a plate 50 is fillet welded 52 to each of the anchors 44 to secure the position of the cantilevered section 18.

Referring again to FIG. 3, in the illustrated embodiment, the pourable bonding material 20 is poured to fill the cavity 28, to fill the hollow interior of the column 12, to fill the hollow voids 40, to embed the connected anchor 44 and plate 50, to embed the supported end 38 of the cantilevered section 18, and to form a floor layer 20*a* on top of both the flooring section 16 and the supported end 38 of the cantilevered section 18. The cavity 28 first channels the pourable bonding material 20 through the openings 24 and into the hollow interiors of the columns 12. Once the columns 12 have filled to the level of the base wall 30 of the beam 14, the cavity 28 begins to fill. As the cavity 28 fills, the connection between the base wall 30 and the plate 50 and the connection between the plate 50 and the anchor 44 are embedded in pourable bonding material 20. Further, the hollow voids 40 fill with pourable bonding material 20. Once the cavity 28 has filled, the floor layer 20*a* begins to form. As the floor layer 20*a* forms, the rebar 46 is embedded in pourable bonding material 20. The floor layer 20*a* can be formed such that the top surface of the floor layer 20*a* is raised with respect to the top surface of the flange 34*a*. The height of the side wall 32*a* is related to the thickness of the floor layer 20*a*.

The top surface of the floor layer 20*a* is raised with respect to the top surface of the cantilevered section 18. There is a lip 54 or ridge between the floor layer 20*a* and the cantilevered section 18. The lip 54 facilitates draining water or directing runoff from the cantilevered section 18. For example, the lip 54 can prevent water from flowing from the cantilevered section 18 to the floor layer 20*a*.

Once the pourable bonding material 20 solidifies, the resulting poured bonding structure 20 integrally connects the columns 12, beams 14, flooring sections 16, and cantilevered sections 18 to provide the integrated building structure 10.

Figure 6:
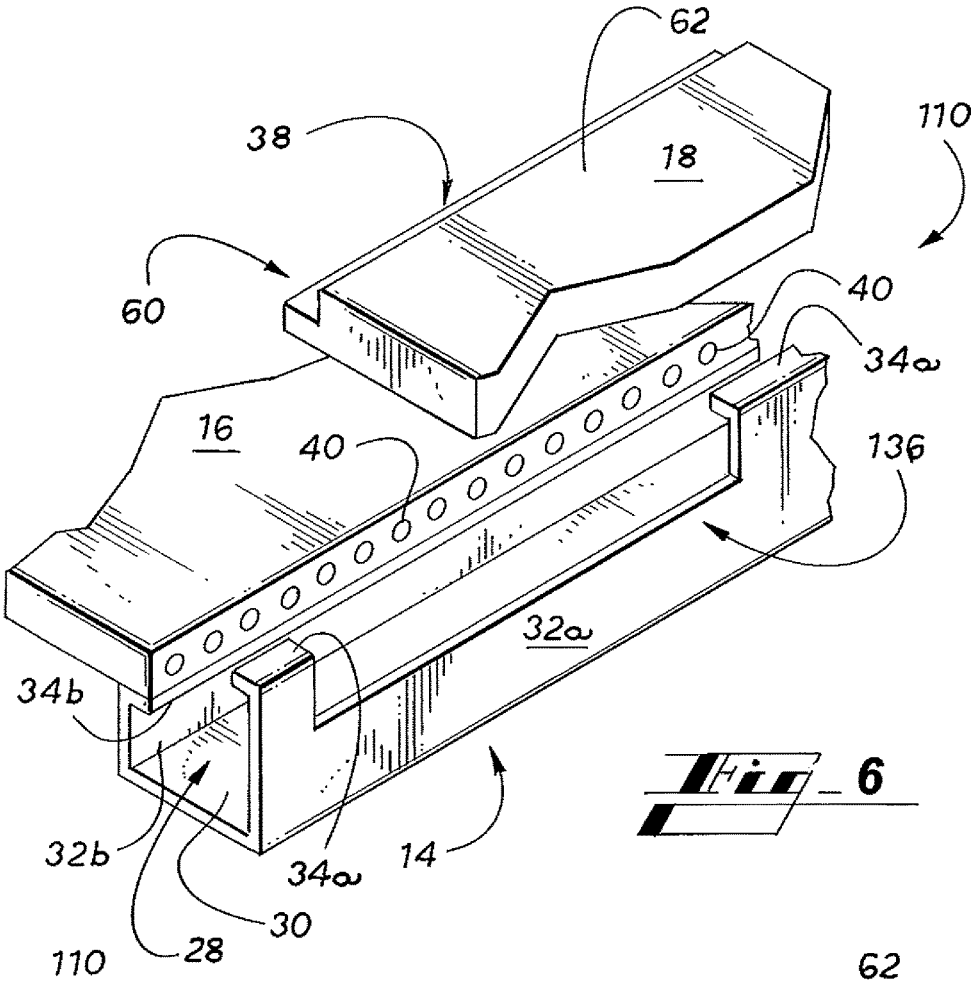
FIG. 6 is an exploded partial perspective view of a framing structure according to a second exemplary embodiment of the present disclosure.
Figure 7:
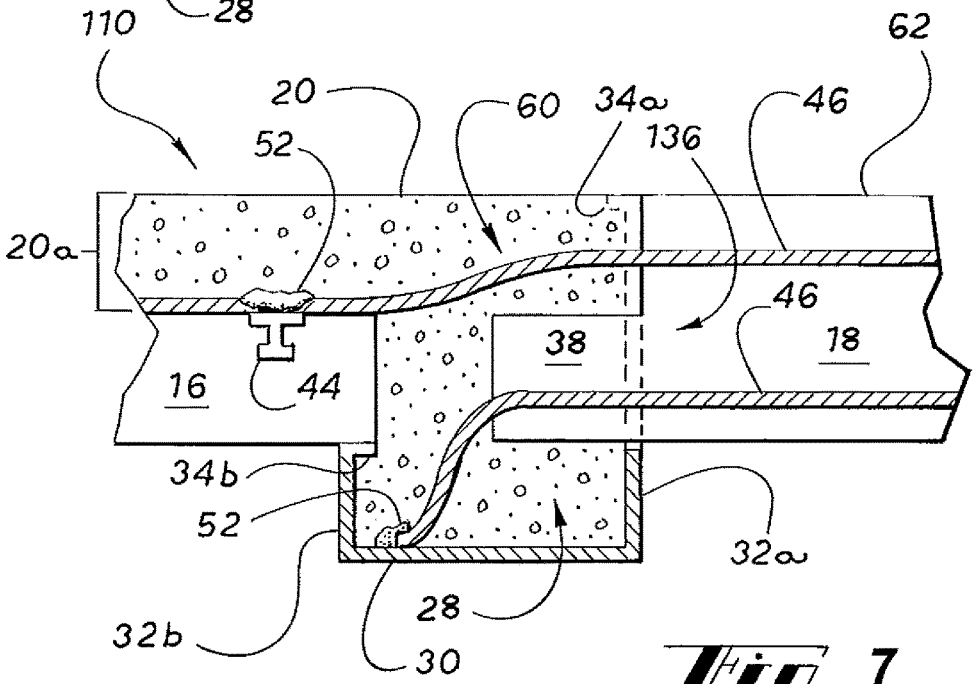
FIG. 7 is a partial cross-sectional view of the framing structure of FIG. 6.

Referring to FIGS. 6 and 7, a second exemplary embodiment of a building structure 110 is described. Where elements of the second exemplary embodiment are substantially similar to those of the first exemplary embodiment, like element designations have been used and the description of such elements will not be repeated except for purposes of teaching. The description of the second embodiment will be directed to elements that are different from those of the first embodiment.

Referring to FIG. 6, a slot 136 is formed in the side wall 32*a* and the flange 34*a* such that the cantilevered section 18 can be received in the slot 136 with the supported end 38 positioned in the cavity 28. The slot 136 permits the cantilevered section 18 to be dropped or lowered into place. In alternative embodiments, the slot can be a notch, a recess, combinations thereof, and the like.

In this embodiment, the supported end 38 is stepped or configured such that the floor layer 20*a* of the poured bonding structure 20 can top the supported end 38. A recess 60 in the supported end 38 provides a region where the poured bonding structure 20 can top the supported end 38. The illustrated slot 136 receives the cantilevered section 18 such that an upper surface 62 of the cantilevered section 18 is substantially coplanar with the upper surface of the flange 34*a* and the upper surface of the poured bonding structure 20. Poured bonding material 20 is obstructed by both the side wall 32*a* and the recess 60 so as not to overflow out of the cavity 28 or onto the upper surface 62 of the cantilevered section 18. This arrangement provides ease of assembly of the building structure 110 and support at the supported end 38.

Also, in the illustrated embodiment, referring to FIG. 7, lengths of rebar 46 that are embedded in the cantilevered section 18 are used to secure the cantilevered section 18 to the flooring section 16 and to the beam 14. An anchor 44 is embedded in the flooring section 16 one length of rebar 46 is secured to the anchor 44 with a fillet weld 52. The other length of rebar 46 is secured to the beam 14 with a fillet weld 52.

Figure 8:
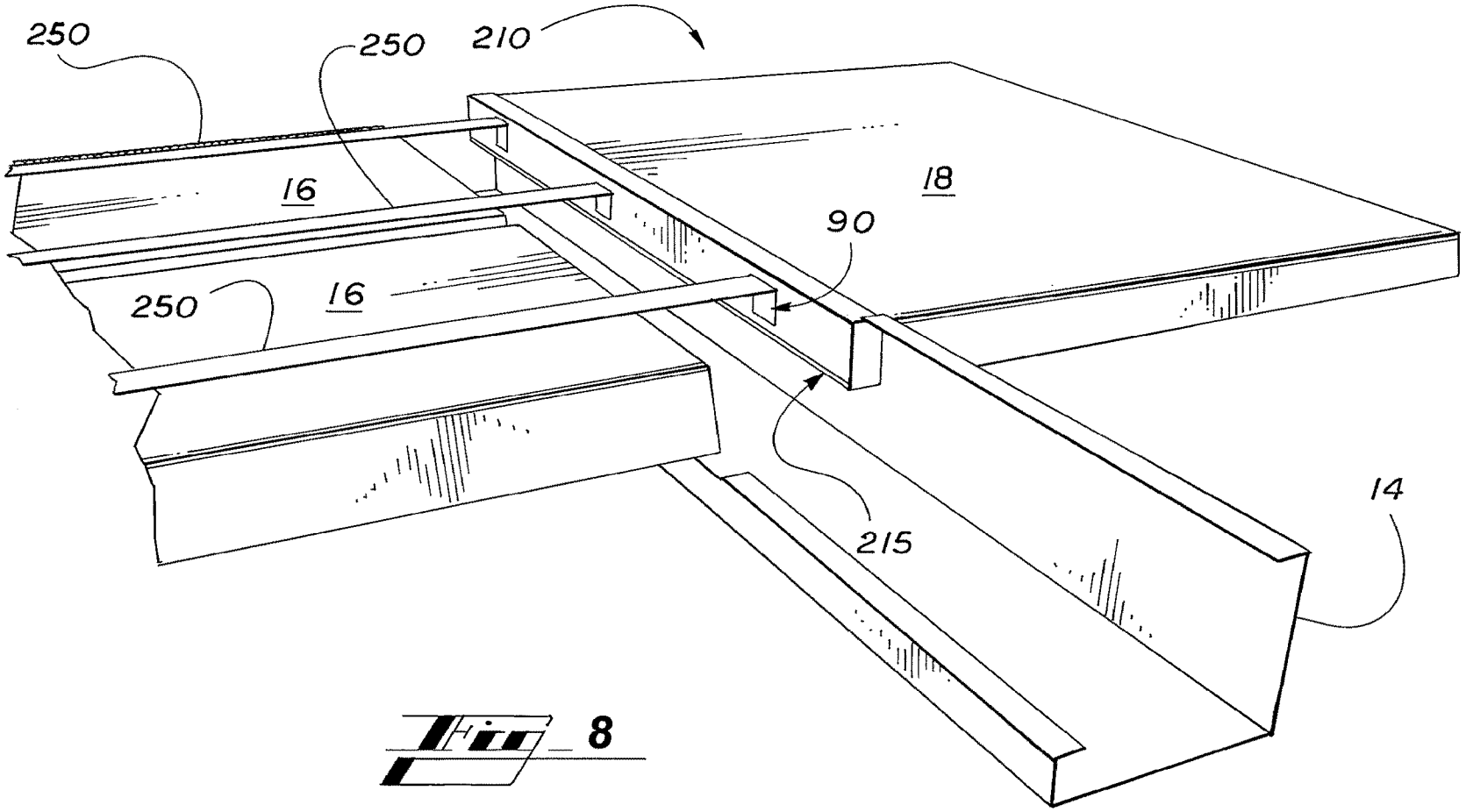
FIGS. 8 and 9 are perspective views of a framing structure according to a third exemplary embodiment of the present disclosure.
Figure 9:
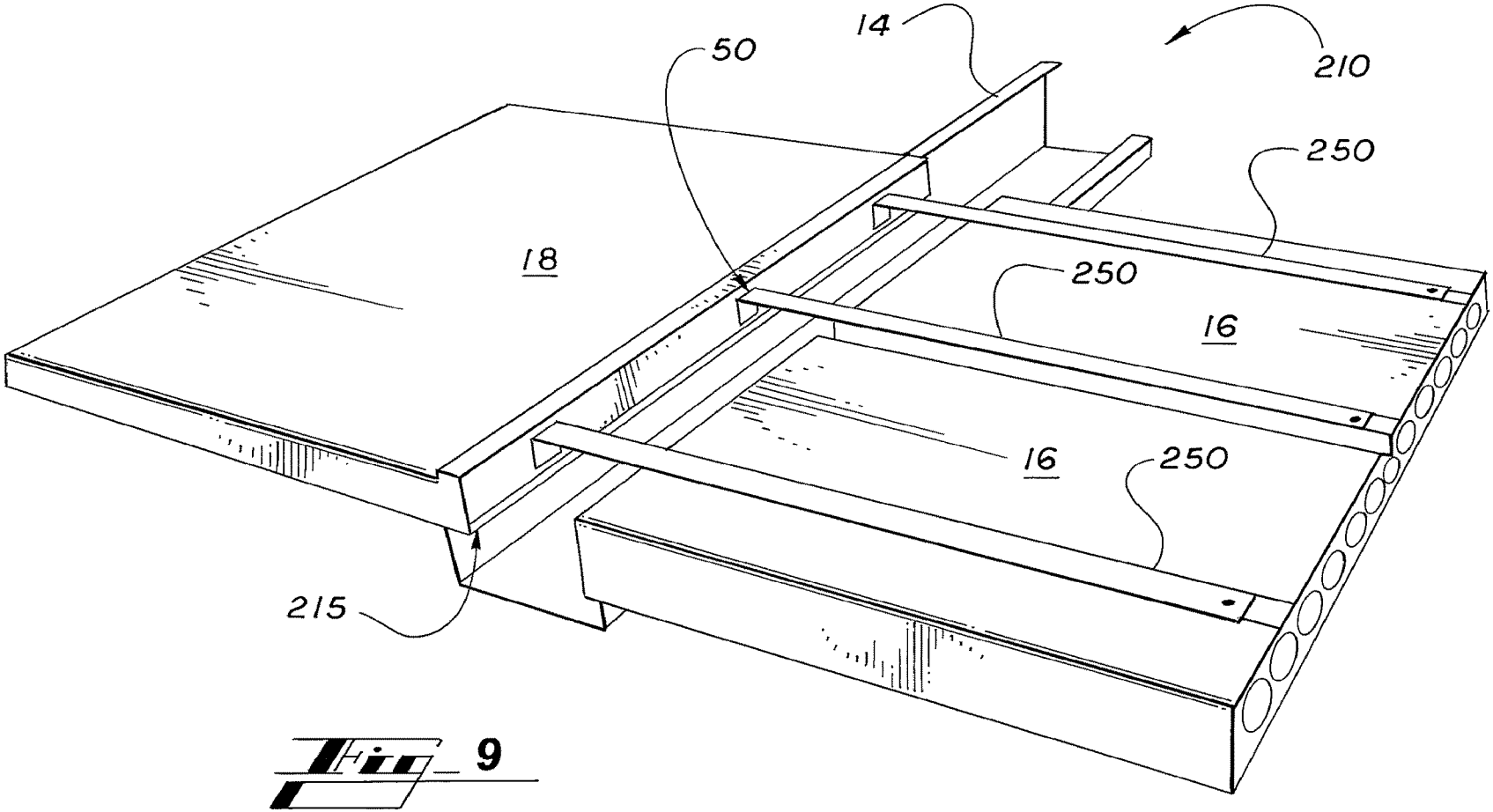

Referring to FIGS. 8 and 9, a building structure 210 includes cantilever support straps 250. One end of each of the support straps 250 is welded to embedded anchors 44 (hidden) in the cantilevered section 18 and the opposed end of each of the support straps is attached to a flooring section 16 with a concrete anchor. The illustrated beam 14 includes a ledge 215 that extends into the cavity 28 and supports and positions the supported end of the cantilevered section 18.

The law does not require and it is economically prohibitive to illustrate and teach every possible embodiment of the present claims. Hence, the above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

The invention claimed is:

1. A building structure, comprising:
- a beam comprising:
  - a base wall; and
  - a sidewall, wherein the base wall and the sidewall at least partially provide an upward facing cavity;
- a cantilevered section, wherein:
  - a supported proximal end of the cantilevered section is positioned in the upward facing cavity with a distance between the sidewall and an innermost end wall of the cantilevered section;
  - a free distal end of the cantilevered section projects from the sidewall; and
  - a lower surface of the cantilevered section is below an upper end of the sidewall; and
- a poured bonding structure that at least partially fills the upward facing cavity.

2. The building structure of claim 1, wherein the sidewall of the beam comprises one of an opening and a slot and the cantilevered section is positioned to extend through the one of the opening and the slot.

3. The building structure of claim 2, wherein the one of the opening and the slot comprises a lower edge that is lower than the upper end of the sidewall.

4. The building structure of claim 1, wherein the supported proximal end of the cantilevered section is embedded in the poured bonding structure.

5. The building structure of claim 1, further comprising a flooring section comprising an end supported by the beam, the end of the flooring section further providing the cavity.

6. The building structure of claim 5, wherein the poured bonding structure comprises a layer on the flooring section and an upper surface of the poured bonding structure is below the upper end of the sidewall.

7. The building structure of claim 6, wherein an upper surface of the poured bonding structure is above an upper surface of the cantilevered section.

8. The building structure of claim 1, further comprising means for securing the position of the supported proximal end of the cantilevered section.

9. The building structure of claim 1, wherein the supported proximal end of the cantilevered section is connected to the building structure.

10. The building structure of claim 1, further comprising at least a first connecting element that is configured to connect the supported proximal end of the cantilevered section to the building structure.

11. The building structure of claim 10, wherein the first connecting element is embedded in the poured bonding structure.

12. The building structure of claim 10, wherein the first connecting element connects the supported proximal end of the cantilevered section to the beam.

13. The building structure of claim 10, wherein the first connecting element comprises a plate that is connected to the beam and an anchor that is at least partially embedded in the cantilevered section, wherein the plate and the anchor are connected to one another.

14. The building structure of claim 1, wherein the sidewall is a first sidewall and the beam further comprises a second sidewall.

15. The building structure of claim 14, wherein the second sidewall further provides the cavity.

16. The building structure of claim 14, comprising a flooring section, wherein an end of the flooring section is supported by the second sidewall.

17. The building structure of claim 16, wherein the second sidewall and the end of the flooring section further provide the cavity.

18. The building structure of claim 5, wherein the poured bonding structure comprises a layer on the flooring section.

19. The building structure of claim 5, further comprising at least a first connecting element that is configured to connect the supported proximal end of the cantilevered section to the flooring section.

20. The building structure of claim 19, wherein the first connecting element is embedded in the poured bonding structure.

* * * * *